United States Patent [19]

England

[11] 3,988,905

[45] Nov. 2, 1976

[54] REVERSIBLE MECHANICAL-THERMAL ENERGY CELL

[76] Inventor: Will Clarke England, 7310 Eastcrest Drive, Austin, Tex. 78752

[22] Filed: Sept. 24, 1975

[21] Appl. No.: 616,336

[52] U.S. Cl. ..... 62/401

[51] Int. Cl.[2] ..... F25D 9/00

[58] Field of Search ..... 62/401, 402, 403; 165/88, 122, 124, 125

[56] References Cited

UNITED STATES PATENTS

| | | | |
|---|---|---|---|
| 1,893,171 | 1/1933 | Kagi | 62/401 |
| 2,393,338 | 1/1946 | Roebuck | 62/401 |
| 2,451,873 | 10/1948 | Roebuck | 62/401 |
| 3,797,559 | 3/1974 | Paul et al. | 165/88 |
| 3,874,190 | 4/1975 | Eskeli | 62/401 |
| 3,886,764 | 6/1975 | Edwards | 62/401 |
| 3,926,010 | 12/1975 | Eskeli | 62/401 |

*Primary Examiner*—Lloyd L. King

[57] ABSTRACT

A reversible mechanical-thermal energy cell comprising: reversible intake and exhaust passages respectively leading to and from reversible rotatably connected rotary intake and exhaust volumetric periodically vanishing displacement devices of unequal rates of volumetric displacement, said rotary intake and exhaust volumetric displacements flowably connected by a reversible compression-expansion conduit, said conduit being in thermal communication with a thermal energy reservoir for containing matter subject to thermal change; and a compressible-expandible fluid reversibly traversing from said intake to said exhaust passage via said volumetric displacements and said conduit, said fluid subject to volumetric, pressure and thermal change in said conduit. Applicable in a range including thermal energy storage and retrieval, heating, cooling, cooking, refrigerating, and of fixed installation or portable.

22 Claims, 9 Drawing Figures

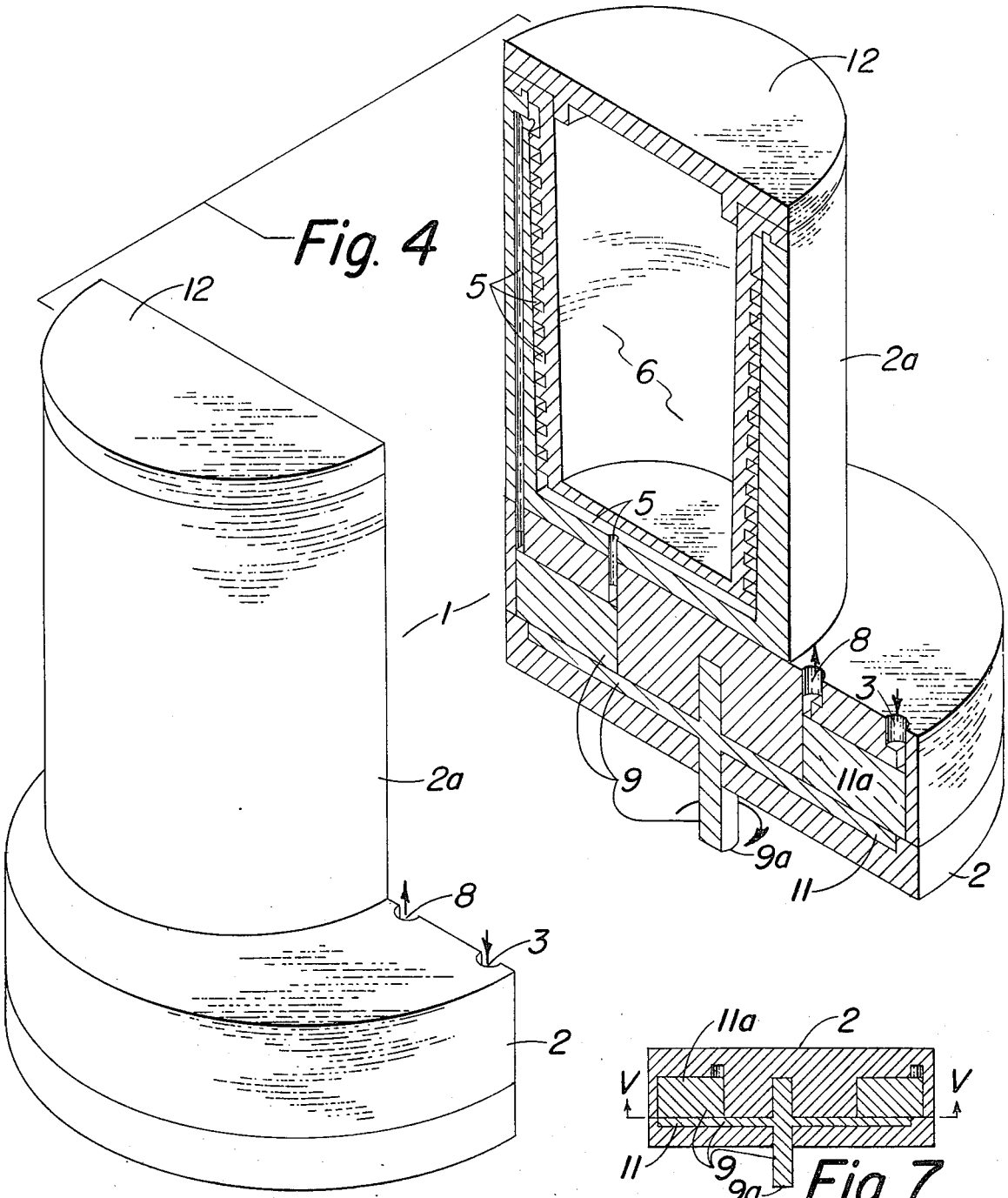
Fig. 4
Fig. 7
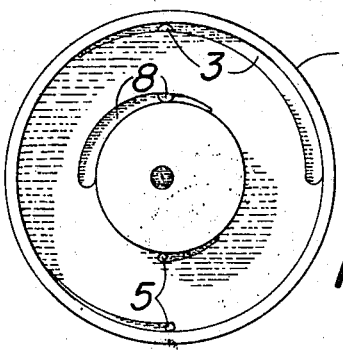
Fig. 5
Fig. 6
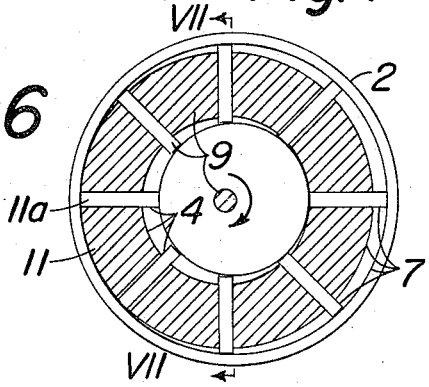

REVERSIBLE MECHANICAL-THERMAL ENERGY CELL

SUBJECT MATTER OF THE INVENTION

The invention relates to energy cells and more specifically to reversible energy cells of mechanical-thermal energy interchange.

OBJECTS OF THE INVENTION

It is an object of this invention to provide a basic reversible thermal energy storage and retrieval cell capable of mechanical energy input and output, fluid pressure energy input and output and thermal energy input and output.

Another object is to provide a device capable of greater or less thermal energy transfer than is mechanically required in terms of energy to make such thermal energy transfer.

A further object is to provide a device applicable in the fields of heating, cooking, cooling and refrigeration which can be of fixed installation or portable.

Still another object is to provide plural capabilities of energy storage and retrieval.

A still further object is to provide a thermal energy cell capable of balancing multiple arrangements of opposing actions or imbalancing multiple arrangements of transposing actions.

Other objects and advantages of this invention will become apparent through consideration of the following description and appended claims in conjunction with the attached drawings in which:

DESCRIPTION OF THE SEVERAL VIEWS OF THE DRAWINGS

FIG. 4 is an exploded sectional pictorial view of a reversible mechanical-thermal energy cell of variable volumetric displacements.

FIG. 5 is a plan view of the inside of the rotary variable volumetric displacement assembly housing taken on line V—V of FIG. 7.

FIG. 6 is a plan view of the rotary variable volumetric displacement assembly taken on line V—V of FIG. 7.

FIG. 7 is a cross-section of the rotary variable volumetric displacement assembly taken on line VII—VII of FIG. 6.

DETAILED DESCRIPTION OF PREFERRED EMBODIMENT OF THE INVENTION

Figure 1:
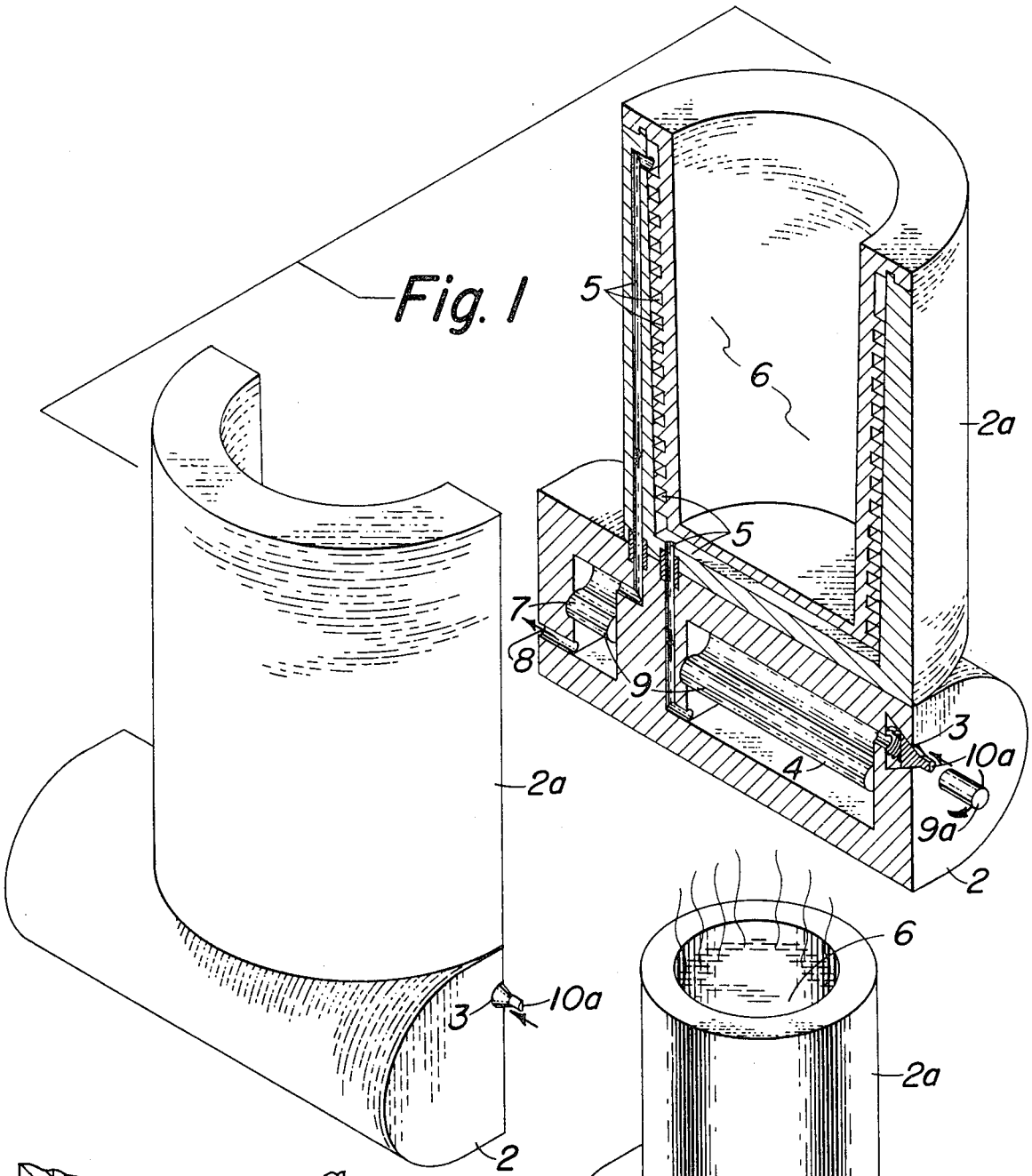
FIG. 1 is an exploded sectional pictorial view of a reversible mechanical-thermal energy cell of constant volumetric displacements.

With reference to the patent drawings, my Invention of a reversible mechanical-thermal energy cell 1 comprises, basically: a reversible intake passage 3 leading to a reversible intake rotary volumetric displacement device 4; a reversible exhaust rotary volumetric displacement device 7 with a reversible exhaust passage 8 leading from said device 7, said intake and exhaust rotary devices being unequal in rates of volumetric displacement and said volumetric displacements significantly vanishing at least once each revolution; a thermal energy reservoir 6 for containing matter subject to a thermal change; a reversible compression-expansion conduit 5 leading from the vanishing side of said rotary intake device 4 to the reappearing side of said rotary exhaust device 7, said conduit in thermal communication with said thermal energy reservoir 6 and said matter subject to a thermal change; and a compressible-expandible fluid subjected to volumetric, pressure and thermal change in said reversible conduit 5, said fluid being displaced after intake from said intake passage 3 via the rotary intake volumetric displacements 4 to said conduit 5 and displaced from said conduit 5 via the rotary exhaust volumetric displacements 7 to the exhaust passage 8 for exhaust. If the intake volumetric displacement rate is greater than the exhaust volumetric displacement rate, then the compressible-expandible fluid will be compressed in said conduit 5, thus raising the temperature of said fluid and causing said fluid to yield some of its thermal energy to the thermal energy reservoir 6 and the matter contained therein. If the intake volumetric displacement rate is less than the exhaust volumetric displacement rate, then the fluid will be expanded in said conduit 5, thus lowering the temperature of said fluid and causing said fluid to absorb some of the thermal energy from the thermal energy reservoir 6 and the matter contained therein. Both of these processes require an input of energy by torque input or sustained pressure differential and are reversible when a thermal differential between the reservoir and the incoming fluid is existent. These processes are transference energy processes as well as energy conversion processes, which is to say that the amounts of thermal energy transferred can exceed the energy required to cause the transfer.

Figure 2:
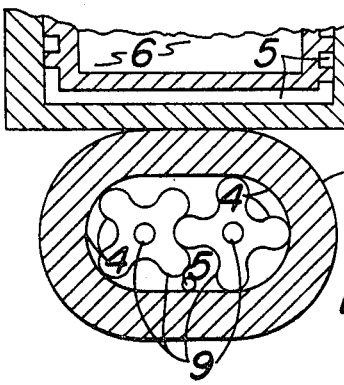
FIG. 2 is a partial cross-section showing the intake constant volumetric displacement device.
Figure 3:
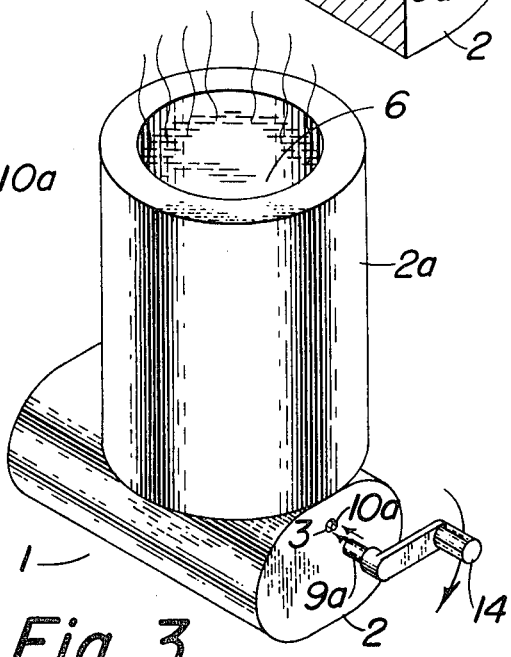
FIG. 3 is a pictorial view of FIG. 1 configuration with a manual torque input for heating the liquid in the thermal energy reservoir.

The rotary volumetric displacement devices include constant volumetric displacement devices such as the intermeshing rotary assembly 9 illustrated in FIGS. 1, 2 and 3. The rotary volumetric displacement devices also include variable volumetric displacement devices such as the radially moveable vane 11*a* and the rotor 11 type rotary assembly 9 illustrated in FIGS. 4, 5, 6 and 7. In either case it is only necessary that the rates of intake and exhaust volumetric displacement be unequal and significantly vanish at least once per revolution.

The design of the rotary volumetric displacement assembly housing 2 is mainly a function of the rotary volumetric displacement devices'geometrical configurations, however, synthesis of the composite parts of the housing 2 is a function of the manufacturing art and machining capabilities. The interior of said housing 2 in conjunction with the rotary assembly 9 form the rotary volumetric displacements.

The reversible intake passage 3 in said housing 2 conveys the compressible-expandible fluid from whatever source to the reversible reappearing side of the intake rotary volumetric displacements and allows said fluid reversible entrance into the rotary displacement volumes. Said passage 3 must only be of adequate size and configuration to accomplish the aforementioned functions.

The thermal energy reservoir 6 is for containing whatever matter is to be subject to thermal change and must be of adequate size for such containment. Said reservoir 6 is also to be in adequate thermal communication with the reversible compression-expansion conduit 5 and in required thermal communication with whatever matter is contained. Said thermal communication includes conduction through the thermal energy reservoir housing 2*a* and at least conduction with said fluid in said conduit 5. The greater the thermal conductivity of the appropriate part of the reservoir housing 2*a*, the more expeditious the thermal energy transfer. The greater the conduit 5 surface area in contact with the appropriate part of the reservoir housing 2*a* and said fluid, the greater the capacity for thermal energy transfer. The greater the contact area between the reservoir housing 2*a* and the matter contained, the greater capacity for thermal energy transfer by conduction. Should a liquid or gas be included in said reservoir 6 the thermal convection or forced circulation could assist the thermal energy transfer. The thermal energy reservoir 6 can be enclosed and include a removeable or permanent cover 12 or said reservoir 6, dependent upon what is to be contained, may be open. The reservoir housing 2*a*, illustrated to be metallic in nature for good thermal conduction, can be of any suitable material with desired conduction characteristics, and the outer part of said housing 2*a* could be of an insulating nature to minimize undesirable thermal energy transfer.

The reversible compression-expansion conduit 5 must be in thermal communication with the thermal energy reservoir 6 and must also convey compressible-expandible fluid from the vanishing side of the intake rotary volumetric displacements to the reappearing side of the exhaust rotary volumetric displacements. As illustrated the conduit 5 is in entire thermal communication with the bottom of the reservoir 6 and spirals around the circular shaped reservoir also for effective thermal communication. Dependent upon the shape of the thermal reservoir 6 and upon desired thermal energy transfer characteristics, the conduit 5 may be comprehensively or only partially in thermal communication with said reservoir 6. The conduit 5 is illustrated as an integral passage through said reservoir housing 2*a* but may be separate so long as it is in said reservoir 6.

The reversible exhaust passage 8 in said housing 2 conveys the compressible-expandible fluid from the reversible vanishing side of the exhaust rotary volumetric displacements and allows reversible exit from the rotary displacement volumes, said exhaust passage 8 reversibly exiting said fluid from the energy cell 1. Said passage 8 must only be of adequate size and configuration to accomplish the aforementioned functions.

The mechanical-thermal energy cell 1 being reversible means that reversing the compression (heating) energy cell 1 in fluid flow and rotation produces an expansion (cooling) energy cell 1 which is to say that the reversed exhaust passage 8 and exhaust volumetric displacement device 7 of a compression cell 1 are the intake passage 3 and intake volumetric displacement device 4 of an expansion cell 1. Thus the structure of a compression cell 1 is the opposite structure of an expansion cell 1, and the functions of one are the opposite of the other.

Figure 8:
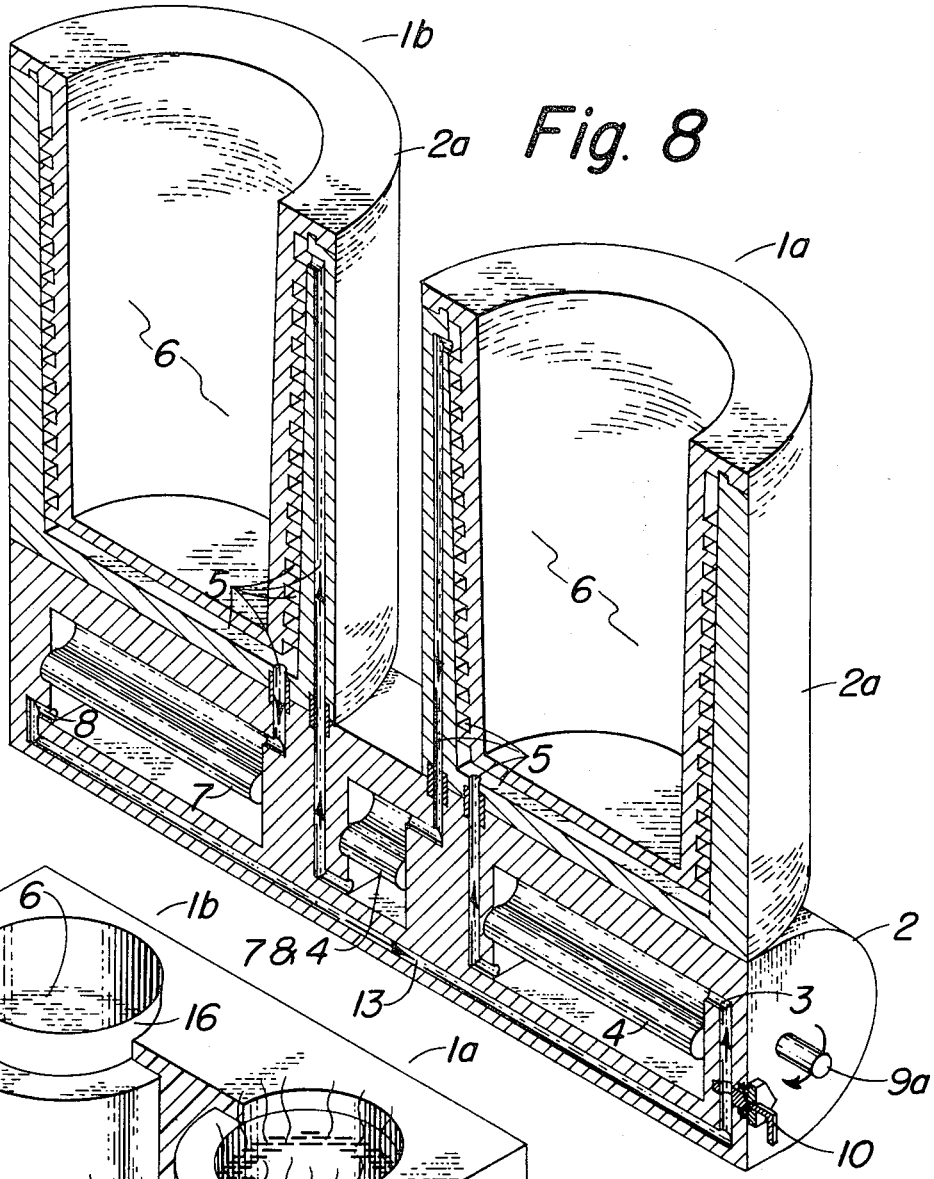
FIG. 8 is a sectional pictorial of an oppositely acting pair of reversible mechanical-thermal energy cells of constant volumetric displacements.
Figure 9:
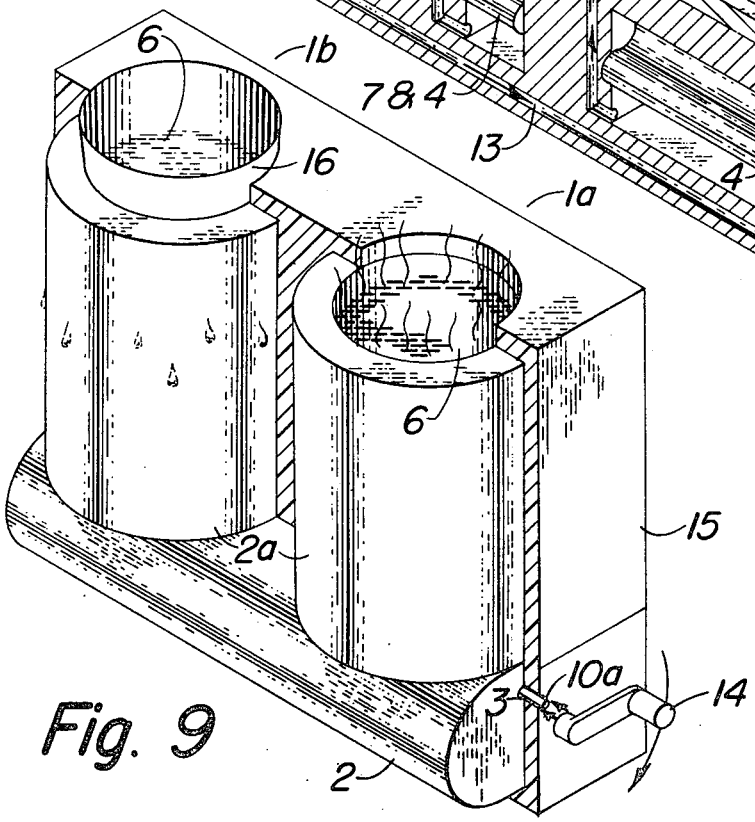
FIG. 9 is a pictorial of an oppositely acting pair of reversible mechanical-thermal energy cells of constant volume displacements with the thermal insulation partially cut away and with manual torque input for heating the initial cell and cooling the sequential cell.

Because the mechanical-thermal energy cell can be mechanically driven, pressure driven or thermally driven, there is a possible plurality of combinations of multiple cells, however, the simplest is a reversible pair of oppositely acting series flow, energy cells with a common intermediate exhaust-intake rotary volumetric displacement device 7 and 4 as is illustrated in FIGS. 8 and 9. FIG. 8 illustrates a reversible pair of oppositely acting mechanical-thermal energy cells, the initial cell 1*a* being a driven compression cell and the sequential cell 1*b* being a driven expansion cell, with either being the other, dependent upon the direction of rotation and fluid flow. As was stated previously the energy cell is an energy transference mechanism, so the oppositely acting dual cell can be a closed fluid system having a recirculating passage 13 from the exhaust rotary device 7 to the intake rotary device 4 and being torque driven. Such a driven dual cell as is illustrated in FIG. 8 has a closed fluid flow system that transfers heat energy to the thermal energy reservoir 6 from said fluid in the initial cell 1*a* and transfers heat energy from the thermal energy reservoir 6 to said fluid in the sequential cell 1*b*. After such a dual cell has been driven and a significant thermal differential exist, the dual cell will act in reverse, if unrestrained, heating the fluid in cell 1*a* causing expansion and cooling the fluid in cell 1*b* causing contraction, both actions reversing the fluid flow, the direction of rotation and actually delivering output torque. One means of restraint is by closure of a control valve means 10 installed in the fluid passages or conduit. Another means of restraint could be a braking means connectable to shaft means 9*a* or to rotary assembly 9. A restraint means illustrated on the basic cell in FIGS. 1 and 3 and on the dual cell in FIG. 9 is a check valve means 10*a* which would allow intake of a fluid from external sources, such as air, during the torque input mode but would restrain reverse fluid flow until the check valve means is manually released; thus giving the operator control over the output mode of the stored energy.

FIG. 9 is an illustration of a portable oppositely acting pair of energy cells, hand crank 14 driven with undesireable thermal energy losses and gains restrained by thermal insulation 15. Such a portable unit could heat soup and chill a drink simultaneously and with a removeable thermal reservoir lining 16 could even provide appropriate washable parts.

In describing one selected form of preferred embodiment of this invention as shown in the drawings and this specification, specific terms and components are used for clarity. However, it is not intended to limit the claimed invention to the specific form components, or construction shown and it is to be understood that specific terms used in this illustration of the invention are intended to include all technical equivalents which operate in a similar manner to accomplish a similar purpose.

OPERATION

It is well known in thermodynamics that a change in the volume of an expandible-compressible fluid also changes the pressure exerted by said fluid and the temperature of said fluid. Now, if one has a pair of rotary volumetric displacement devices, rotatably connected and fluid flowably connected, then if the volume introduced by the intake rotary device 3 is unequal to the volume correspondingly removed by the exhaust rotary device 7, a corresponding change in the pressure and temperature will occur in the fluid flowing in the conduit 5 flowably connecting said intake and exhaust rotary volumetric displacement devices. As the conduit 5 is in thermal communication with a thermal energy reservoir 6 and the matter contained therein, then a transferance of thermal energy will occur between the fluid in said conduit 5 and the matter in the thermal energy reservoir 6. Conversely if matter at a temperature unequal to the temperature of said fluid in said conduit 5 is introduced into said thermal energy reservoir 6, then again a transference of thermal energy will occur and a corresponding change in the volume and pressure of said fluid will also occur, thus driving the rotary devices accordingly.

In the input energy modes the rotary volumetric displacement devices can either be: torque driven by hand, engine or motor or some other mechanical output system; or driven by an externally imposed pressure differential applied to the fluid between the intake passage 3 and the exhaust passage 8; or driven by a thermally altered fluid, said fluid altered by thermal exchange with the matter introduced into the thermal energy reservoir 6.

For a basic reversible mechanical-thermal energy cell 1, said intake rotary volumetric displacement rate exceeding said exhaust rotary volumetric displacement rate, the following applies:

1. When said energy cell is torque driven, with the incoming volume of fluid exceeding the outgoing volume, compression occurs in the conduit, raising the temperature of the fluid so that thermal or heat energy is transferred to the thermal energy reservoir and the matter contained therein. When the torque input is removed the heated matter transfers the heat energy stored back to the fluid which expands after intake thus causing a reverse of the directions of rotation and fluid flow and producing a torque output and/or pressure differential between intake and exhaust.
2. When said energy cell is differential pressure driven, the intake pressure is multiplied in the conduit and the compressed fluid again yields heat energy to the thermal energy reservoir. Upon removal of the applied pressure differential the stored heat energy returns to the incoming fluid and produces a torque output and/or pressure differential between intake and exhaust. Because of the pressure multiplication and opposing torque in the conduit there is a limiting ratio of intake to exhaust volume (for air about 1.8) which when exceeded in an energy cell cannot be pressure driven because the internal pressure eventually checks the fluid flow.
3. For said energy cell with incoming volume exceeding exiting volume to be thermally driven, a cold substance such as liquid air is introduced or poured into the thermal energy reservoir. Such a cold substance would absorb thermal or heat energy from a fluid such as atmospheric air causing said fluid to contract and create a torque imbalance toward intaking normal air and exhausting cooler air. This cell could yield an output torque somewhat limited by the external pressure.

For a basic opposite reversible mechanical-thermal energy cell 1, said exhaust rotary volumetric displacement rate exceeding said intake rotary volumetric displacement rate, the following applies:

1. When said energy cell is torque driven, with the outgoing volume exceeding the incoming volume, expansion occurs in the conduit, decreasing the temperature of the fluid so that thermal or heat energy is transferred from the thermal energy reservoir and the matter contained therein to said fluid. When the torque input is removed the cooled matter will absorb heat energy from the fluid, contracting said fluid and creating a torque imbalance toward reversed fluid flow and rotation.
2. When said energy cell is differential pressure driven, the intake pressure is decreased by expansion and again absorbs thermal energy from the energy reservoir and the matter therein. Upon removal of the applied pressure differential the cooled matter will absorb heat energy from the fluid, contracting said fluid and creating a torque imbalance toward reversed fluid flow and rotation.
3. For said energy cell with outgoing volume exceeding incoming volume to be thermally driven, a hot substance such as molten metal is poured or introduced into the thermal energy reservoir. Such a hot substance yields heat energy to a fluid such as air causing said fluid to expand and produce a torque output and/or pressure differential between intake and exhaust.

If a rather continuous heat energy source were installed in the thermal energy reservoir of the basic cell with outgoing volume exceeding incoming volume, a power plant would be created. Such a continuous heat energy source could be a self-sustaining nuclear fission reaction which could easily be controlled if the fuel segments and alternate moderator segments were in circular rings with every other ring rotatably adjustable from one end so that the fuel segments could be radially aligned or checker boarded with moderator segments. In an oppositely acting pair of energy cells the fluid could be recirculated and the energy output could be torque output and boiling water from the other cell to remove the unconverted heat energy.

The limiting effect occuring in the pressure driven compression energy cell of the incoming to outgoing volumetric ratio could easily be overcome by a fluid bypass leading from the conduit 5 to either the exhaust passage or some other low pressure area. Such a bypass conduit could also be included on any energy cell with a control valve means included to control the bypass fluid flow, thus partially controlling the efficiency of the energy cell and the thermal, torque and pressure characteristics.

The oppositely acting pair of energy cells illustrated in FIG. 8 is a balanced compression and expansion system with thermal balance or equivalence in the thermal energy reservoirs. Such a balanced system when being torque driven with a recirculating fluid loop will drive cell 1*a* to a heated condition and cell 1*b* to a cooled condition, stabilizing at conditions on either side of the surrounding temperature. If an imbalanced closed system, say with greater expansion than compression exist, then the thermal differential between cells will still exist but both hot and cold cells will be transposed toward absolute zero. If compression exceeds expansion, then the transposition will be toward a hotter mean.

If a pair of oppositely acting energy cells were contrived such that the heating cell was installed inside the cooling cell, then cooking could be done inside the heating cell and the waste heat counteracted in the cooling cell, thus cool cooking is possible. What is even more significant is that this type of contrivance, being a thermal energy transference process mostly, could be extremely more efficient than direct conversion of electricity or gas to heat energy. The temperature of such a cool cooking contrivance could easily be adjustable by a fluid bypass with a control valve means.

Because of the three functional characteristics of the reversible energy cell there is a plurality of combinations of multiple cell arrangements available:

1. Input mechanical energy-rotatably connected cells
   a. Series fluid flow-oppositely acting cells
   b. Parallel fluid flow-similarly acting cells
2. Input mechanical energy-rotatably independent cells
   a. Series fluid flow-oppositely acting cells
   b. Parallel fluid flow-similarly acting cells
3. Pressure differential drive
   a. Series fluid flow-oppositely acting cells
      1. Rotatably connected
      2. Rotatably independent
   b. Parallel fluid flow-similarly acting cells
      1. Rotatably connected
      2. Rotatably independent
   c. Parallel fluid flow-paired oppositely acting cells
      1. Rotatably connected-pairs-multiple
      2. Rotatably independent
4. Thermal energy transference
   a. Series fluid flow-oppositely acting cells
      1. Rotatably connected
      2. Rotatably independent
   b. Parallel fluid flow-similarly acting cells
      1. Rotatably connected
      2. Rotatably independent
   c. Parallel fluid flow-paired oppositely acting cells
      1. Rotatably connected-pairs-multiple
      2. Rotatably independent Dependent upon the utility of such multiplicities, plural combinations of such arrangements could be alternately operable.

One could also have multiplicities of cell elements such as multiple thermal energy reservoirs in series or parallel flow with other elements in common. One torque input compression cell intaking hot air sharing a common thermal energy reservoir with one torque output expansion cell intaking cool air could actually produce a net gain of mechanical energy. A sequence of rotatably connected intake or exhaust rotary volumetric displacement devices in series flow could increase the expansion or compression and in parallel flow could enlarge the fluid flow.

ADVANTAGES

A discussion of the advantages of a reversible mechanical-thermal energy cell should be first served by comparison of said cell with an electrical lead-acid storage auto battery. A survey of such auto batteries on the market revealed the storage capacity of such to be about 21 watt-hours per pound of battery. The thermal characteristics of water are:

Specific Heat =0.29 watt-hours per pound per°Rankine

Heat of Fusion = 42.2 watt-hours per pound

Heat of Vaporization = 284.4 watt hours per pound

In other words a pound of ice melted, boiled and vaporized requires 388.7 watt-hours of heat energy which would require about an 18.5 pound auto battery's storage capacity. This should be a sufficient introductory comparison between electrical energy and thermal energy storage capacities.

A material advantage of this Invention is provision of an alternate means of energy storage and retrieval of comparable capacity.

A further advantage is provision of a direct thermal energy transference system capable of transfering more thermal energy than required to make said transfer.

Another advantage is provision of an energy cell of multiple function and multiple reversibility.

Although this specification described but one embodiment of the invention with certain modifications thereof, it is understood that structural or material rearrangements of adequate or equivalent parts, substitution of equivalent parts and other modifications in structure can be made and other applications devised without departing from the scope of my invention. I therefore desire that the description and drawings herein be regarded as only an illustration of my invention and that the invention be regarded as limited only as set forth in the following claims, or as required by the prior art.

Having thus described my invention, I claim:

1. A reversible mechanical-thermal energy cell comprising:

a. a reversible rotary intake volumetric displacement device, said intake volumetric displacements significantly vanishing at least once each revolution;

b. a reversible rotary exhaust volumetric displacement device, said exhaust volumetric displacements significantly vanishing at least once each revolution, with the rate of said exhaust volumetric displacements being unequal to the rate of said intake volumetric displacements, said rotary intake and exhaust devices being rotatably connected;

c. a reversible intake passage leading to the reappearing volumetric displacement side of said reversible rotary intake volumetric displacement device;

d. a reversible exhaust passage leading from the vanishing volumetric displacement side of said reversible rotary exhaust volumetric displacement device;

e. a thermal energy reservoir for containing matter subject to a thermal change;

f. a reversible compression-expansion conduit leading from the vanishing side of said reversible rotary intake volumetric displacement device to the reappearing side of said reversible rotary exhaust volumetric displacement device, said conduit in thermal communication with said thermal energy reservoir and said matter subject to a thermal change; and g. a compressible-expandible fluid subjected to volumetric, pressure and thermal change in said reversible conduit, said fluid being volumetrically displaced from said intake passage to said conduit via the rotary intake volumetric displacements and from said conduit to said exhaust passage via the rotary exhaust volumetric displacements, and said fluid undergoing a change in energy characteristics in said reversible mechanical-thermal energy cell.

2. In a reversible energy cell according to claim 1, said reversible rotary intake volumetric displacements exceeding said reversible rotary exhaust volumetric displacements in volumetric displacement rate, said rotary volumetric displacement devices being driven by any externally applied driving means inclusive of mechanical torque input, applied pressure differential between intake and exhaust passages and input of matter into said thermal reservoir thermally different from said compressible-expandible fluid.

3. In a reversible energy cell according to claim 1, said reversible rotary exhaust volumetric displacements exceeding said reversible rotary intake volumetric displacements in volumetric displacement rate, said rotary volumetric displacement devices being driven by any externally applied driving means inclusive of mechanical torque input, applied pressure differential between intake and exhaust passages and input of matter into said thermal reservoir thermally different from said compressible-expandible fluid.

4. A multiplicity of reversible mechanical-thermal energy cells according to claim 1, said multiplicity of cells being rotatably connected.

5. A multiplicity of reversible mechanical-thermal energy cells according to claim 2, said multiplicity of cells being rotatably connected.

6. A multiplicity of reversible mechanical-thermal energy cells according to claim 3, said multiplicity of cells being rotatably connected.

7. A multiplicity of reversible mechanical-thermal energy cells according to claim 1, said multiplicity of cells flowably connected in parallel fluid flow.

8. A multiplicity of reversible mechanical-thermal energy cells according to claim 1, said multiplicity of cells being rotatably connected and flowably connected in parallel fluid flow.

9. A multiplicity of reversible mechanical-thermal energy cells according to claim 1, said multiplicity of cells flowably connected in series fluid flow, said flowably connected rotary exhaust to intake volumetric displacement devices approximately equal in rates of volumetric displacement.

10. A multiplicity of reversible mechanical-thermal energy cells according to claim 1, said multiplicity of cells being rotatably connected and flowably connected in series fluid flow, said flowably connected rotary exhaust to intake volumetric displacement devices approximately equal in rates of volumetric displacement.

11. A reversible energy cell as described in claim 1, including a control valve means for controlling said reversible compressible-expandible fluid flow through said reversible energy cell.

12. A reversible energy cell as described in claim 1, including a braking means for controlling the reversible rotation of said rotary intake and exhaust devices in said reversible energy cell.

13. A reversible energy cell as described in claim 1, including thermal insulation means to retard the reversible thermal energy loss of said reversible energy cell.

14. A reversible energy cell as described in claim 1, including a reversible pressure driving and utilizing means flowably connected to said fluid passages.

15. A reversible energy cell as described in claim 1, including a reversible power driving and utilizing means rotatably connected to said rotary intake and exhaust devices.

16. A pair of oppositely acting reversible mechanical-thermal energy cells as described in claim 1, flowably connected in series flow, said reversible rotary exhaust volumetric displacement device of the initial energy cell also being the reversible rotary intake volumetric displacement device of the sequential energy cell.

17. A pair of oppositely acting, thermally balanced, reversible mechanical-thermal energy cells as described in claim 1, flowably connected in series flow, said reversible rotary exhaust volumetric displacement device of the initial energy cell also being the reversible rotary intake volumetric displacement device of the sequential energy cell; and said rotary intake device of the initial cell and said rotary exhaust device of the sequential cell being approximately equal in rates of volumetric displacement.

18. A pair of oppositely acting reversible energy cells as described in claim 16, including a control valve means for controlling said reversible compressible-expandible fluid flow through said oppositely acting energy cells.

19. A pair of oppositely acting reversible energy cells as described in claim 16, including an enclosed passage flowably connecting the exhaust passage of the sequential cell with the intake passage of the initial cell.

20. A pair of oppositely acting reversible energy cells as described in claim 19, including a control valve means for controlling said reversible compressible-expandible fluid flow through said oppositely acting energy cells.

21. In a reversible energy cell according to claim 1, at least one of the rotary volumetric displacement device 5 being a variable volumetric displacement device.

22. In a reversible energy cell according to claim 1, at least one of the rotary volumetric displacement devices being a multirotary intermeshing constant volumetric displacement device.

* * * * *